US009953477B2

(12) United States Patent
Meganck et al.

(10) Patent No.: US 9,953,477 B2
(45) **Date of Patent: *Apr. 24, 2018**

(54) MOBILE KEY DEVICES SYSTEMS AND METHODS FOR PROGRAMMING AND COMMUNICATING WITH AN ELECTRONIC PROGRAMMABLE KEY

(71) Applicant: ACSYS IP HOLDING INC., Beirut (LB)

(72) Inventors: David Meganck, Guang Dong (CN); Ahmad Fares, Beirut (LB); Karim Belhadia, Guang Dong (CN); Jean Mouradian, Guang Dong (CN)

(73) Assignee: ACSYS IP HOLDING, INC, Beirut (LB)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,950

(22) Filed: Nov. 23, 2016

(65) Prior Publication Data

US 2017/0076527 A1 Mar. 16, 2017

Related U.S. Application Data

(63) Continuation of application No. 14/715,893, filed on May 19, 2015, now Pat. No. 9,542,785.

(60) Provisional application No. 62/000,511, filed on May 19, 2014.

(51) Int. Cl.
*G07C 9/00* (2006.01)

(52) U.S. Cl.
CPC ..... *G07C 9/00857* (2013.01); *G07C 9/00309* (2013.01); *G07C 9/00674* (2013.01); *G07C 9/00706* (2013.01); *G07C 2009/0088* (2013.01); *G07C 2009/00761* (2013.01); *G07C 2009/00769* (2013.01); *G07C 2009/00865* (2013.01)

(58) Field of Classification Search
CPC ..... G07C 9/00309; G07C 9/00706; G07C 9/00857; G07C 2009/00769; G07C 2009/00761; G07C 2009/00865; G07C 2009/0088
See application file for complete search history.

(56) References Cited

U.S. PATENT DOCUMENTS 9,542,785 B2 * 1/2017 Meganck ..... G07C 9/00309

* cited by examiner

*Primary Examiner* — Leon-Viet Nguyen
(74) *Attorney, Agent, or Firm* — Bryan Cave LLP

(57) ABSTRACT

Systems, methods, and apparatuses for communicating information, altering access rights, and transferring power to and from an electronic programmable key are disclosed. Using a wireless channel of communication established between the key and a mobile device, information and access rights can be communicated from and to the electronic programmable key. Using the mobile communication device's network connection, a further channel of communication may be established between a control center and the electronic programmable key.

12 Claims, 10 Drawing Sheets

MOBILE KEY DEVICES SYSTEMS AND METHODS FOR PROGRAMMING AND COMMUNICATING WITH AN ELECTRONIC PROGRAMMABLE KEY

CROSS-REFERENCE TO RELATED APPLICATIONS

The present application is a continuation application of U.S. patent application Ser. No. 14/715,893 filed May 19, 2015, which claims priority to U.S. Provisional Patent Application No. 62/000,511 filed May 19, 2014. The entire contents of the above applications are incorporated by reference as if recited in full herein.

FIELD OF THE INVENTION

The present invention is related to electronic programmable key and mechatronic lock systems, and more particularly, to controlling access rights of an electronic programmable key and communicating information to and from the electronic programmable key.

BACKGROUND

In electronic programmable key and mechatronic lock systems, electronic programmable keys are generally blocked or disabled from unlocking a mechatronic lock until they are provided with a passcode. The electronic programmable keys are typically equipped with a keypad for entering a passcode, which may be a sequence of letters, numbers, symbols, or a combination thereof. Once a key holder enters a passcode into the electronic programmable key, the electronic programmable key is no longer blocked and becomes enabled to unlock the mechatronic lock. Thus, in comparison to conventional mechanical key and lock systems, additional security is provided against fraudulent usage or when keys are lost or stolen; in the event a key is lost or stolen, the lost or stolen key is unusable because it cannot be used without a valid passcode.

Electronic programmable keys may be programmed to unlock a lock or padlock according to certain access rights. More specifically, an electronic programmable key may be programmed to only unlock a designated set of mechatronic locks, and only at certain predetermined times of the day, week, month, and/or year. Moreover, electronic programmable keys or mechatronic locks may store records of access logs that show the times and locations where the electronic programmable key was used.

The passcodes and corresponding access rights are typically created by electronically programming the key itself. To do this, the electronic programmable key may be physically placed into or accessed through a key programming device. Key programming devices are typically stationary, and may comprise, or may need to be connected to, a desktop computing system where an administrator may securely create, edit, or delete locks and keys, and define or refine their access rights. Further, the key programming devices may be used to download a record of access logs generated by the key.

However, current electronically programmable keys are typically deployed and in the possession of individuals who may be in the field, facility, or on site. In order for the key to be programmed, it would have to be brought to an administrator and connected to key programming devices which are typically integrated with stationary computing systems or networks, such as for example a desktop computer. Similarly, in order for a key holder to be able to successfully operate the key in the desired mechatronic lock, he or she may have to request a valid code from the administrator which in turn would be entered into the key. Thus, an administrator cannot grant—and a key holder cannot efficiently request—new passcodes, access rights or access logs on demand and in real-time, while the key holder is in the field or within proximity to the mechatronic lock to which access is desired. Similarly, an administrator cannot directly verify that certain tasks have been completed without recovering the keys or accessing the mechatronic locks, and may have to rely instead on the user to manually report such activities. Rather, a key holder typically travels to the nearest stationary key programming device to reprogram the key or download access logs.

Accordingly, a need exists to provide a mobile key reader or programming device that establishes a connection between the electronically programmable key and a server for accessing information from, and/or defining access rights for, the electronic programmable key.

SUMMARY OF THE INVENTION

In various embodiments, the invention provides systems, methods, and apparatuses for communicating information, altering access rights, and transferring power to and from an electronic programmable key. A mobile key interface device is configured to couple to a contact pin of the electronic programmable key, and communicate to a mobile communication device. Using the mobile communication device's network connection, the mobile key interface device establishes a channel of communication from a control center to the electronic programmable key.

According to certain embodiments, the electronic programmable key includes a key body, a key shaft and a microcontroller. Information may be communicated to and from the electronic programmable key using a mobile key interface device. The key shaft includes a first contact pin for communicating to the mobile key interface device. A mobile key interface device may include a first distal end and a second distal end substantially opposite the first distal end. The first distal end has an opening where a user inserts the electronic programmable key. The second distal end is substantially opposite the first distal end. The mobile key interface device has an elongated hollow interior portion that extends from the first distal end towards the second distal end and the hollow interior is shaped so as to substantially encase the key body. The mobile key interface device may further include a key port proximate to the second distal end. The key port has a second contact pin located such that it is coupled to the first contact pin when the electronic programmable key is inserted into the mobile key interface device. When the first contact pin is coupled to the second contact pin, the mobile key interface device may retrieve information from the electronic programmable key, alter access rights of the electronic programmable key, or transfer power to the electronic programmable key. In this way, the mobile key interface device provides on-demand access to the electronic programmable key in near real-time.

In other embodiments, various steps may be performed to establish communication between the electronic programmable key and mobile key interface device. When the first contact pin is coupled to the second contact pin, the electronic programmable key is initialized. The electronic programmable key may then transmit a polling signal to the first contact pin. Using the coupled connection between the first and second contact pins, the electronic programmable key may then query the mobile key interface device for identification information. The mobile key interface device may then be authenticated based on the received identification information. When the mobile key interface device is authenticated, a channel of communication is established that facilitates the exchange of communication and transfer of power to the electronic programmable key.

In some embodiments, the microcontroller and wireless transceiver are housed in the electronic programmable key. The microcontroller may provide and control communication of access information to the wireless transceiver.

BRIEF DESCRIPTION OF THE FIGURES

The objects and features of the invention can be better understood with reference to the following detailed description and accompanying figures.

DESCRIPTION OF THE INVENTION

Embodiments of the present invention include a mobile key interface device. The mobile key interface device may read information from an electronic programmable key and/or set access rights that restrict the usage of the electronic programmable key. The mobile key interface device may include a key port for connecting to and communicating with an electronic programmable key, and a mobile communication device port, for connecting to and communicating with a mobile communication device. The mobile communication device port may be a wired or wireless hardware interface that electronically communicates passcodes, access rights, and access logs to and from a mobile communication device. According to some embodiments, the mobile communication device port may be a receptacle for interfacing with a wired connection, such as a USB, FireWire, Ethernet, or similar cable for connecting to a mobile communication device. According to further embodiments of the invention, the mobile communication device port may be a wireless transceiver that transmits and/or receives wireless signals, such as a Wi-Fi, Bluetooth, RFID, or similar NFC device. In one aspect of the invention, the mobile key interface device is portable, and does not need to be connected to or docked to a stationary computing system. Thus, the mobile key interface device is capable of being operated by a user in the field.

Figure 1:
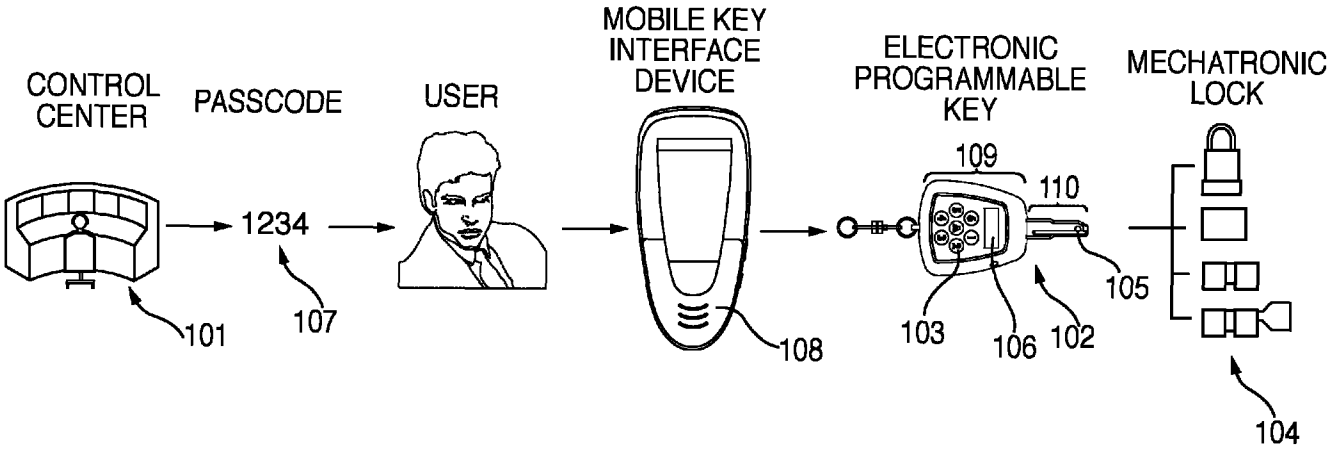
FIG. 1 is a system for obtaining access to a mechatronic lock with an electronic programmable key according to embodiments of the invention.

FIG. 1 depicts a system for controlling a user's access to a mechatronic lock with an electronic programmable key according to embodiments of the invention. The system includes a mechatronic lock 104, an electronic programmable key 102 for opening the mechatronic lock 104, a passcode 107 for enabling the electronic programmable key, a mobile key interface device 108, and a control center 101 for providing a passcode. The mechatronic lock 104 includes a cylinder with mechanical grooves that correspond to a mechanical coding, a processor for receiving electronic communications from an electronic programmable key, a clutch mechanism for engaging a cam, and a memory for storing information, such as access logs. The mechatronic lock 104 may conform to a standard profile design, such as for example, a Europrofile design (also sometimes referred to as a Euro DIN cylinder), oval, round, Scandinavian, Japanese, Union or Schlage type of profile. Further, the processor on the mechatronic lock 104 may be battery-powered, or powered by drawing charge from the electronic programmable key. In this way, the mechatronic lock may be retrofitted to standard door frames without the addition of wires or other parts. For example, a mechatronic lock equipped with a processor that communicates to an electronic programmable key can be swapped with a Europrofile lock without retooling the mortise or lock body of a door.

The electronic programmable key 102 includes a key body 109, keypad 103 for entering a passcode 107, a key shaft 110 with mechanical grooves that correspond to a mechanical coding of a matching mechatronic lock 104, and a contact pin 105 located on the key shaft. The electronic programmable key may further include an LCD screen 106 for displaying information to a user.

To open a mechatronic lock, a user enters a passcode 107 onto the electronic programmable key. If the electronic programmable key determines the passcode is valid, the electronic programmable key will become enabled to electronically communicate to a mechatronic lock. After entering a passcode 107 onto the keypad 103, the user may insert the electronic programmable key 102 into the mechatronic lock 104. The electronic programmable key 102 will open the mechatronic lock if the key shaft has mechanical coding that matches the grooves of the mechatronic lock cylinder 104, and additionally, communicates an electronic message to a processor in the mechatronic lock 104. The electronic message communicated to the processor in the mechatronic lock 104 will include an instruction to activate the clutch mechanism in the mechatronic lock 104. Once the clutch mechanism engages the cam, the user may rotate the key, thereby rotating a dead bolt connected to the cylinder and unlocking the mechatronic lock 104. If the user has entered an invalid passcode, the electronic programmable key will not instruct the mechatronic lock 104 to engage the cam, and the user will not be able to unlock the deadbolt. In this way, a user may be prevented from unlocking a mechatronic lock without a valid passcode, even if the key has a mechanical coding that matches the mechanical coding of the mechatronic lock's cylinder.

In one aspect of the invention, the passcode 107 may contain letters, numbers, symbols, or any combination thereof. The passcode may be dynamic or fixed. A dynamic passcode is a unique, single-use, time-limited or one-time passcode that is generated upon request. A user may obtain a dynamic passcode by request to a control center 101. According to some embodiments, the request may be made using a phone by calling or texting the control center for access to a particular lock. If the control center grants the user access to the lock, an operator at the control center may provide the user with a dynamic passcode, or may send the dynamic passcode to the user via text, which he or she may input into the keypad of the electronic programmable key. The passcode is based in part on the time the user requested the passcode. The electronic programmable key validates the passcode with a process stored in its microcontroller. The stored process on the electronic programmable key parallels the steps performed by the control center, and generates a passcode based on the time of the request. The time at the electronic programmable key is determined by a built-in calendar and clock discussed in more detail below. If the stored process generates a matching passcode, the electronic programmable key will communicate electronically to the mechatronic lock. If, however, the passcode entered by the user does not match the passcode generated by the electronic programmable key, the electronic programmable key will not communicate electronically to the mechatronic lock. In this way, if a user's electronic programmable key is lost or stolen, the electronic programmable key cannot be used to gain access to a mechatronic lock without the additional knowledge of a valid passcode. Because the dynamic passcode is generated based in part on the time it was requested, the validity of the passcode may be time-limited. After a pre-determined period of time has elapsed, the dynamic passcode will no longer be valid for use.

According to other embodiments, the passcode may be fixed for regular and ongoing use. A fixed passcode does not change, and its validity does not expire. An electronic programmable key may validate a fixed passcode by comparing the passcode entered by the user to passcodes stored on the electronic programmable key.

When the user enters a valid dynamic passcode or fixed passcode, the electronic programmable key may then communicate electronically to the mechatronic lock. As explained above, the mechatronic lock is unlocked once the electronic programmable key sends an instruction to the clutch mechanism to engage the cam. According to some embodiments of the invention, the electronic programmable key may send the instruction to engage the clutch based in part on the identification information of the mechatronic lock. For example, in some embodiments, each electronic programmable key may be programmed with a stored list of mechatronic locks it is authorized to access. In other embodiments, the passcode entered by the user may include a series of bits that correspond to a mechatronic lock that the electronic programmable key is authorized to access. For example, the last digit of the passcode may correspond to a mechatronic lock ID number, for which the electronic programmable key is intended to use. When an electronic programmable key is inserted into a mechatronic lock, the electronic programmable key may retrieve its ID number and determine whether it is a mechatronic lock that the electronic programmable key is authorized to access. In this way, the user cannot defraud the control center and attempt to access locks they were not intended to have access to. For example, a user may fraudulently represent to the control center that he or she is located at the site of a mechatronic lock having ID number 1. The control center may communicate a passcode to the user, with the intent that the user will only access the mechatronic lock with ID number 1. If the user enters the passcode, but then attempts to access a different lock, such as for example, mechatronic lock ID number 2, the electronic programmable key will read that mechatronic lock's ID and determine that it is unauthorized to open that particular lock. According to some embodiments, the mechatronic lock ID numbers may correspond to groups of locks. For example, each mechatronic lock located on the first floor of an office building may be associated with a first ID (e.g., 101), while each mechatronic lock located on the second floor may be associated with a second ID (e.g., 102).

When communication between an electronic programmable key and mechatronic lock has been established, the electronic programmable key may retrieve access logs from the mechatronic lock. Each time a user attempts to obtain access to a lock, the mechatronic lock may create an access log that stores the date, time, and ID of the electronic programmable key seeking access to the mechatronic lock. The mechatronic lock may further record information including whether a user attempted to open a lock where he or she had no authorization to open the lock. When the electronic programmable key is electronically communicating to the mechatronic lock, the electronic programmable key may retrieve these access logs stored in the lock's memory. The electronic programmable key may then communicate the access logs to a control center using a mobile key interface device as described in more detail below.

As discussed in greater detail below, a mobile key interface device may be used to control which mechatronic locks an electronic programmable key may access without reprogramming the electronic programmable key in a stationary programmer. Using a mobile key interface device, the control center may change the mechatronic locks that the electronic programmable key is permitted to access in near real-time. Further, a mobile key interface device may be used to transmit access logs stored on and retrieved by the electronic programmable key without uploading the access logs onto a stationary programmer. For example, a user may wish to obtain access to a new lock that it did not previously have access to while the user is in the field. Instead of waiting until the user returns to a stationary programmer to change the access rights of the electronic programmable key, the user may request access in near real-time by establishing a connection to the control center with the mobile key interface device and his or her mobile communication device, and sending a request to access that particular lock. The control center may then approve or deny the request for access. If the control center approves of the request for access, the control center may grant access to the lock by communicating to the electronic programmable key via the mobile key interface device. In some embodiments, access may be granted by communicating a dynamically generated passcode to the user, which in turn, may then be input to the electronic programmable key.

Figure 2A:
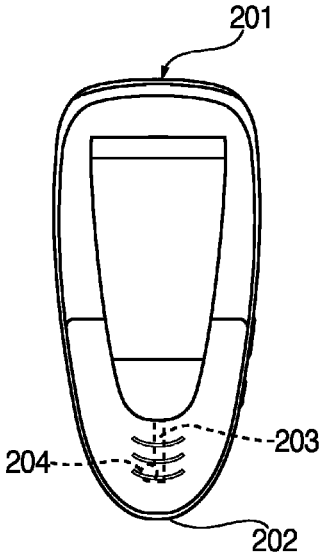
FIGS. 2A, 2B, 2C, 2D, and 2E are views of the exterior and interior of a mobile key interface device from several perspectives according to embodiments of the invention.
Figure 2B:
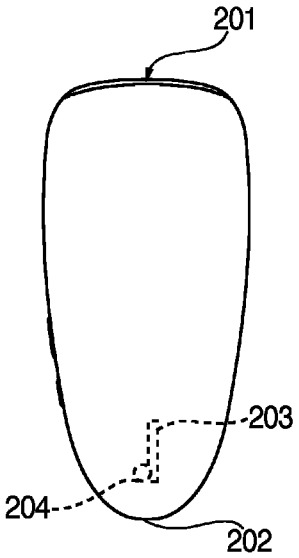
Figure 2C:
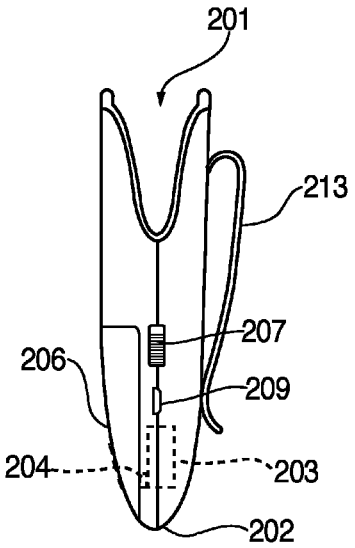
Figure 2D:
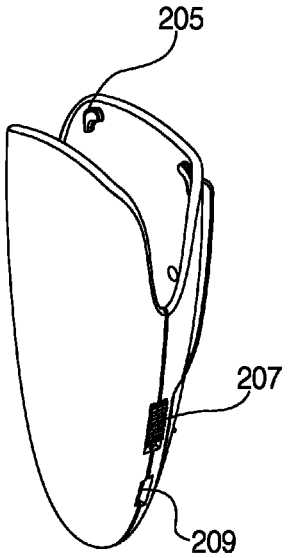

FIGS. 2A, 2B, 2C, 2D, and 2E show back, front, side, and angle views of an exemplary mobile key interface device respectively. The mobile key interface device includes an exterior shell that is shaped to substantially encase the electronic programmable key body or portions thereof, and an interior key port 203 that matches the mechanical grooves of the electronic programmable key shaft, or at least large enough to receive the key's shaft. As shown in FIG. 2D, the interior may further include hooks 205 for ensuring the key body stays in place. When an electronic programmable key is inserted into the key port, a contact pin of the electronic programmable key aligns with and couples to a contact pin 204 of the mobile key interface device. The shell may be constructed of a hard material such as metal or plastic that protects covered portions of an electronic programmable key or internal circuitry from damage.

An electronic programmable key may be inserted into the mobile key interface device through a first end 201, and guided through the elongated interior 210 into a key port. Substantially opposite the first end 201 is a distal second end 202. According to some embodiments of the invention, the internal portion of the mobile key interface device surrounding the key port proximate to the distal second end 202 may include a mobile communication device port 209, power source 206, and/or microcontroller 212, as described in more detail below. In embodiments where the distal second end 202 includes a wired mobile communication device port, such as a USB, FireWire, or similar interface, the distal second end 202 may be a detachable and removable cap. For example, when connecting the mobile key interface to a smartphone via a USB port, the second end may be uncapped, and the USB port may be inserted into a smartphone. FIGS. 2B and 2C, show the back and side views of the mobile key interface device, respectively. As shown in FIGS. 2B and 2C, the mobile key interface device may further include a mounting disposed on the exterior surface for attachment of a belt clip 213. As shown in FIGS. 2C and 2D, the mobile key interface device may further include an on/off switch 207 by which a user can power the mobile key interface device on or off.

Figure 2E:
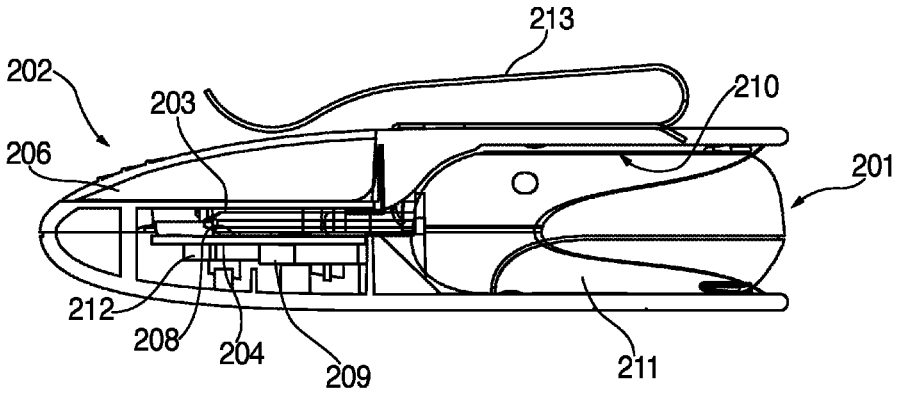

FIG. 2E shows a side view of an exemplary mobile key interface device with an electronic programmable key inserted into its interior and its key port. The side view shows a first distal end 201 and second distal end 202. A portion of the interior 210 of the mobile key interface device proximate to the first distal end 201 is shaped to encase the key body 211. The key port 203 is located substantially proximate to the second distal end 202. The mobile key interface device may include a mobile communication device port 209, and microcontroller 212, located proximate to the second distal end. When the key shaft is inserted into the key port 203, the contact pin on the key shaft 208, makes contact with the contact pin 204 which is coupled to the microcontroller 212 and mobile communication device port 209. The mobile key interface device may further include a power source, located in the area designated as 206, and which may be coupled to the microcontroller 212 and/or mobile communication device port 209.

In certain embodiments, the key port of the mobile key interface device may be a cradle having a minimal size to fit a key, providing a compact overall size and allowing for easy storage. The mobile key interface device may have a belt clip, pocket clip, keychain clasp, or similar latch for convenient attachment to a piece of clothing, bag, or accessory. However, it will be understood that the mobile key programming device does not have any restrictions in shape or size, as long as there is a connection between the key and the control center.

Figure 3A:
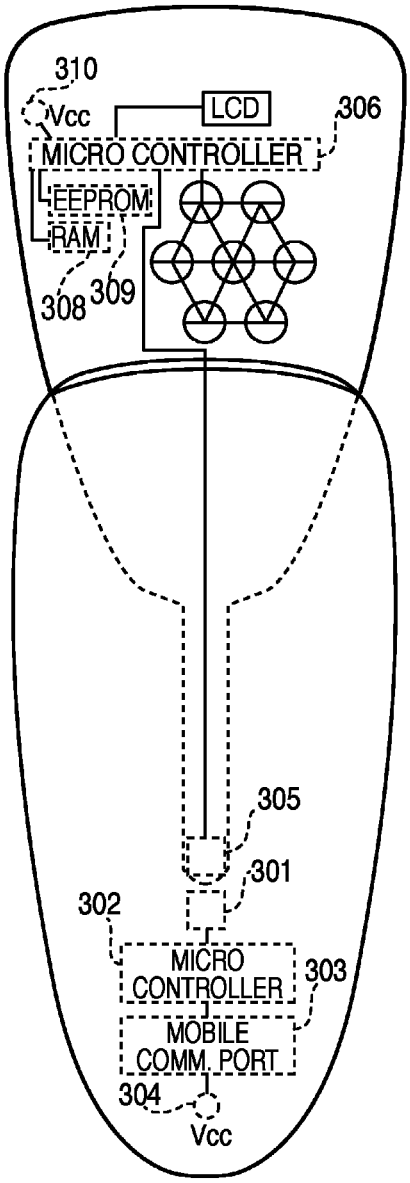
FIGS. 3A, 3B, 3C, and 3D are diagrams of the interior components of a mobile key interface device according to embodiments of the invention.

FIGS. 3A, 3B, 3C, and 3D show interior views of mobile key interface devices with electronic programmable keys inserted into their openings according to various embodiments of the invention. According to one embodiment, the mobile key interface device includes a contact pin 301, microcontroller 302, mobile communication device port 303, and power source 304, as shown in FIG. 3A. The contact pin 301 is an electrically conductive pad that is electrically coupled to the electronic programmable key when placed in physical contact with the electronic programmable key's contact pin, shown as 305. Contact pin 301 receives access information from an electronic programmable key by establishing a connection with contact pin 305 on the shaft of the electronic programmable key. Access information is stored on a local memory of the electronic programmable key, such as for example RAM 308 or EEPROM 309, and provided to the mobile key interface device by coupling the contact pins. The coupling of the contact pins provides a two-way communication channel between the mobile key interface device and the electronic programmable key, and a channel for transferring power between the two devices. Contact pin 301 also provides identification information about the mobile key interface device to the electronic programmable key or an external mobile communication device. For example, each mobile key interface device may have a unique identification number. This identification information may then be communicated to a control center for tracking and monitoring purposes, or to control access to electronic programmable keys, as explained in more detail below. The electronic programmable key communicates access and identification information to and from the mobile key interface device according to the methods described below.

In addition to communicating access and identification information, the contact pins 301 and 305 can be used to deliver charge from the mobile key interface device to the electronic programmable key. The microcontroller 302 receives the access information from contact pin 301 and processes the information to produce an output signal for mobile communication device port 303 to transmit to an external device. For example, the mobile communication device port may be a wireless transceiver that communicates to a smartphone or similar mobile device. Power source 304 provides power to the microcontroller 302 and mobile communication device port 303, as well as the components of the electronic programmable key. In the event that the power source of the electronic programmable key is depleted or fails, the power source 304 of the mobile key interface device may deliver power to the electronic programmable key. By coupling the contact pins of the mobile key interface device and electronic programmable key, charge in the power source 304 may be delivered to the electronic programmable key, recharging the power source of the electronic programmable key.

In one aspect of the invention, the mobile key interface device communicates information received from the electronic programmable key to a mobile communication device using the mobile communication device port. According to some embodiments, the mobile communication device port may transmit the information to the mobile communication device wirelessly via a wireless transmitter. For example, the wireless transmitter may communicate the information from the electronic programmable key using Bluetooth, Wi-Fi, Zigbee, or similar wireless protocol. According to other embodiments, the mobile communication device port may transmit the information over a wired connection. For example, the mobile communication device port may be a USB, FireWire, HDMI, ethernet or similar wired interface. In this way, the mobile key interface device may be a dongle for connecting an external device to the electronic programmable key.

Figure 3B:
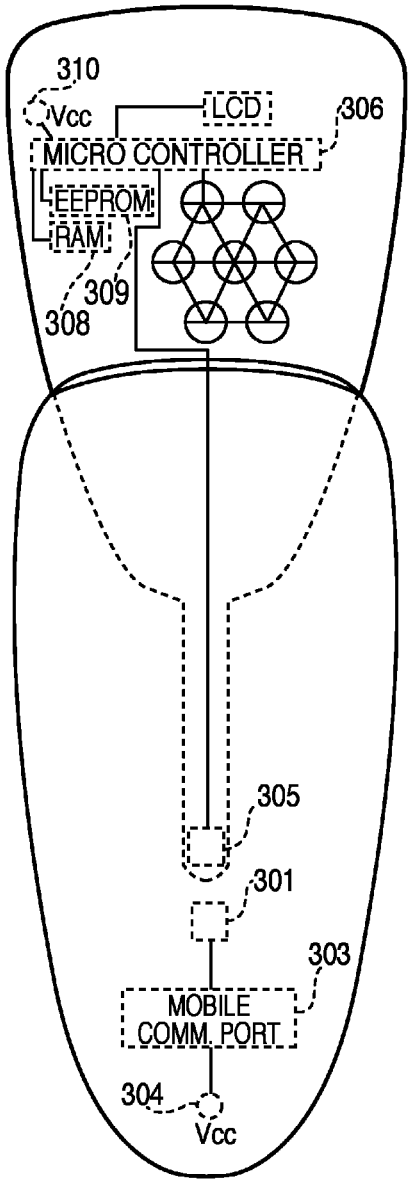

FIG. 3B illustrates other embodiments, where the mobile key interface device includes a mobile communication device port 303 and power source 304, but no microcontroller. In comparison to FIG. 3A, microcontroller 306, which is housed in the electronic programmable key, controls communication to the mobile communication device port 303 in the mobile key interface device. The mobile communication device port 303 transmits all information it receives from microcontroller 306 in the electronic programmable key.

Figure 3C:
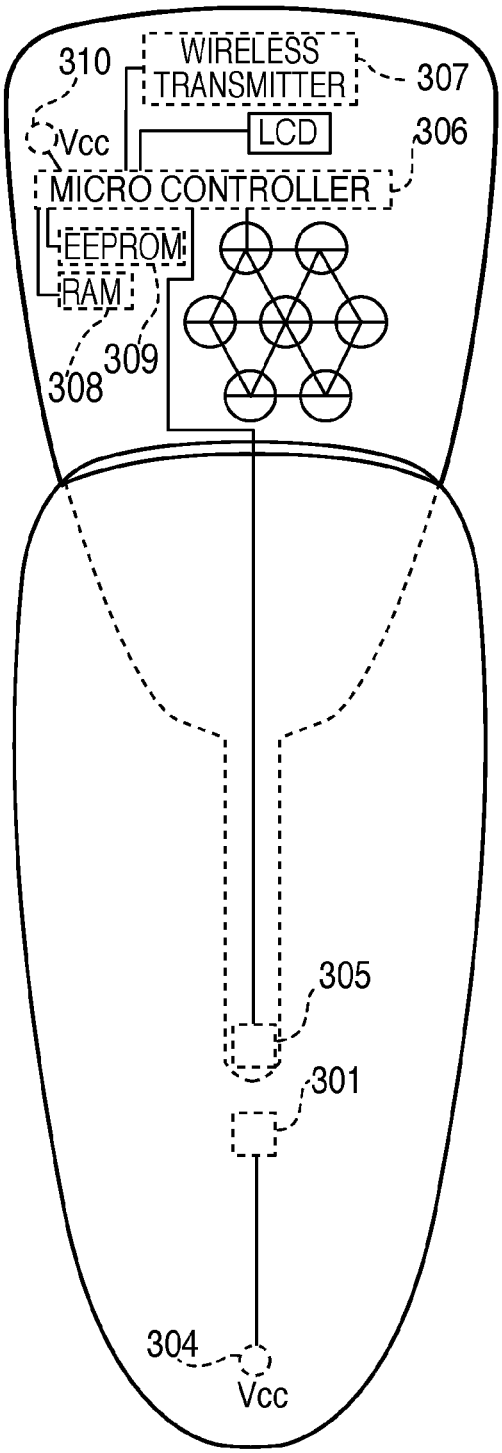

FIG. 3C shows embodiments of the mobile key interface device that includes a power source 304, but no microcontroller or mobile communication device port. In comparison to FIGS. 3A and 3B, the mobile communication device port is a wireless transceiver 307 and both the microcontroller 306 and wireless transceiver 307 are housed in the electronic programmable key. The microcontroller 306 provides and controls communication of access information to the wireless transceiver 307. Power source 304 delivers charge to the electronic programmable key in the event that the power source on the electronic programmable key is depleted or fails.

Figure 3D:
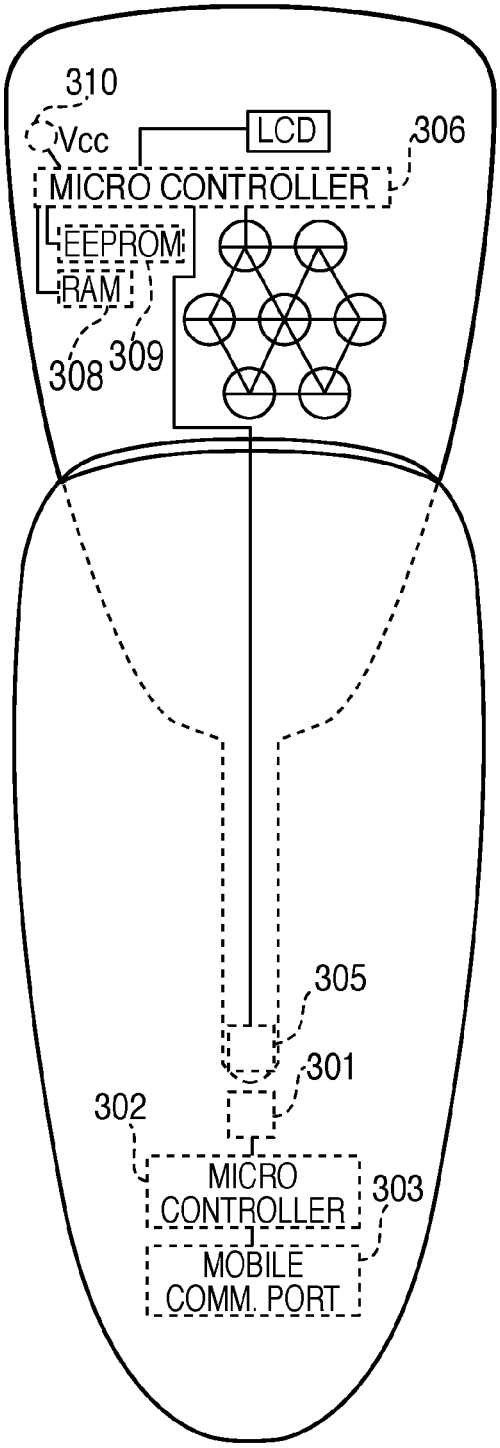

FIG. 3D shows embodiments of the mobile key interface device that includes a mobile communication device port 303 and microcontroller 302, but no power source 304. In comparison to FIGS. 3A, 3B, and 3C, where either the microcontroller 302, mobile communication device port 303, or electronic programmable key are powered by a power source 304, the microcontroller 302, or mobile communication device port 303 may draw charge from a power source 310 on the electronic programmable key.

Figure 4:
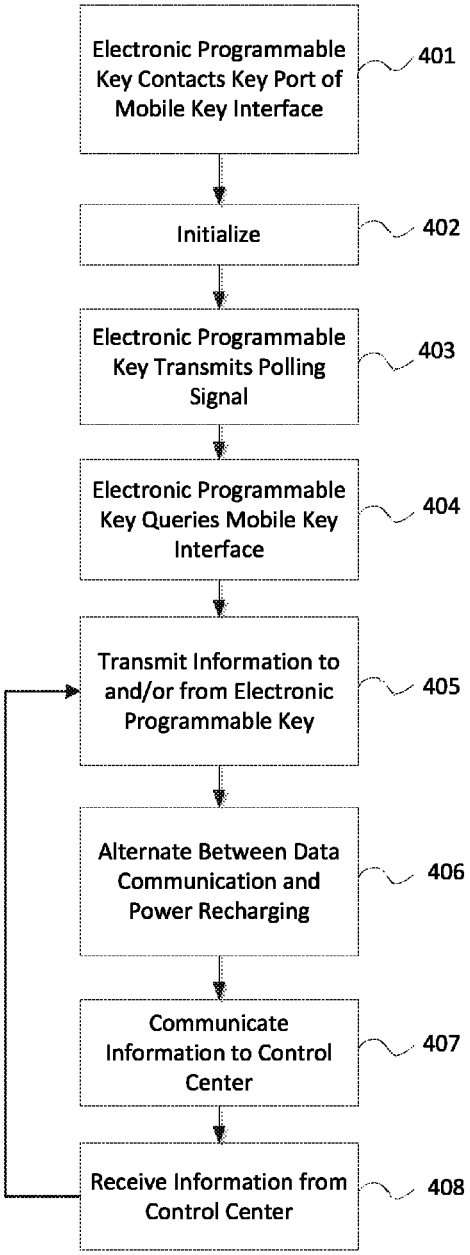
FIG. 4 shows a method for establishing communication between an electronic programmable key and a mobile key interface device.

FIG. 4 illustrates methods for a mobile key interface device to communicate to an electronic programmable key according to embodiments of the invention. It should be noted that in some embodiments of the invention, some of the steps depicted in FIG. 4 may be skipped or are not implemented. In step 401, the contact pin of the electronic programmable key (305 of FIG. 3A) is electrically coupled to the contract pin of the mobile key interface device (301 of FIG. 3A). Electrically coupling the two contact pins triggers the electronic programmable key to initialize a communication session with a mobile communication device, shown as step 402. The initialization phase shown as step 402 prepares the electronic programmable key for communication of the access information stored in its local memory (308 and 309 of FIG. 3A) to a mobile communication device port (303 of FIG. 3A). In step 403, the electronic programmable key sends a polling signal to contact pin 301. If the mobile key interface device includes a microcontroller 302, microcontroller 302 provides the electronic programmable key with its identification information, as shown in step 404. In step 405, the electronic programmable key determines whether it has permission to communicate to the mobile key interface device, based on its identification information. For example, according to some embodiments, each electronic programmable key may be pre-programmed to communicate to a predetermined mobile key interface device or group of mobile key interface devices using their identification information. If the electronic programmable key determines that it has permission to communicate to the mobile key interface device, the electronic programmable key then begins retrieving the access information from its local memory and transmitting the access information to a mobile communication device. In step 405, the communication may be a retrieval of information on the electronic programmable key (e.g., access logs), a programming of the electronic programmable key, or both. In embodiments where the microcontroller 302 is located in the mobile key interface device, the electronic programmable key communicates the access information to the mobile key interface device via the contact pins 301 and 305. In some embodiments, the mobile communication device may then communicate the information from the electronic programmable key to a control center, as shown in step 407. According to other embodiments, the control center may communicate information to the electronic programmable key, such as for example, an alteration of access rights. Such information may be received, as shown in step 408. The received information may then be transmitted to the electronic programmable key as shown in step 405.

Figure 6:
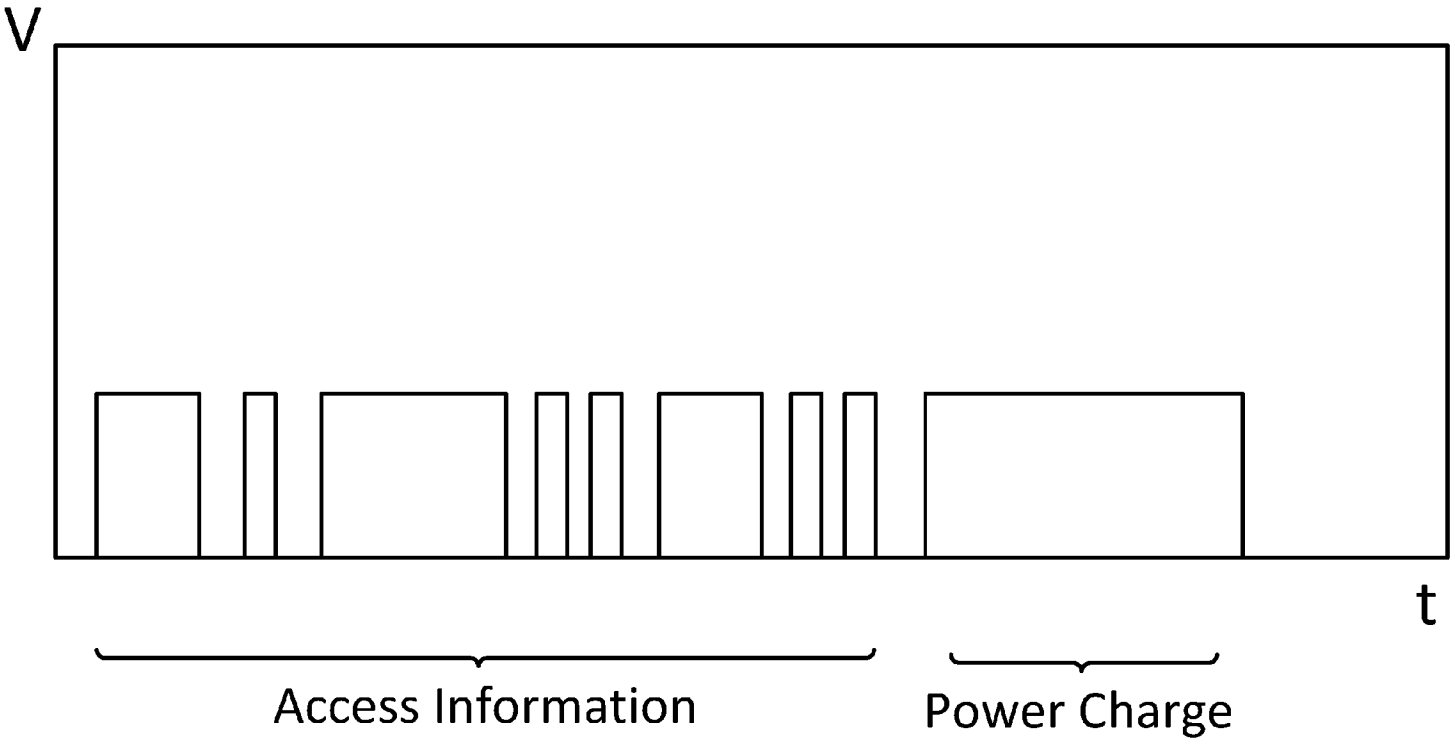
FIG. 6 shows a graph of the digital bits communicated from an electronic programmable key which alternate between information and power delivery from the mobile key interface device according to embodiments of the invention.

In one embodiment of the invention, the access information is communicated to the mobile key interface device via a single contact pin. In the event that the power source in the electronic programmable key has depleted or failed, and the electronic programmable key depends on the power source 304 in the mobile key interface device for power, then the electronic programmable key alternates between communicating information and drawing power from the mobile key interface device. For example, the electronic programmable key may transmit a series of bits containing access information for a period of time, after which the mobile key interface device may then deliver a constant supply of charge from which the electronic programmable key may use to recharge its power supply, as shown in FIG. 6. Thus, the electronic programmable key and mobile key interface device may be synchronized to alternate between communicating access information and delivering charge.

In one aspect of the invention, the communication between the electronic programmable key and the mobile key interface device may be encrypted. For example, the access information may be encrypted using an AES encryption algorithm and a 128-bit, 192-bit or 256-bit encryption key. The access information is transmitted in its encrypted form to and from the mobile key interface device.

Figure 5:
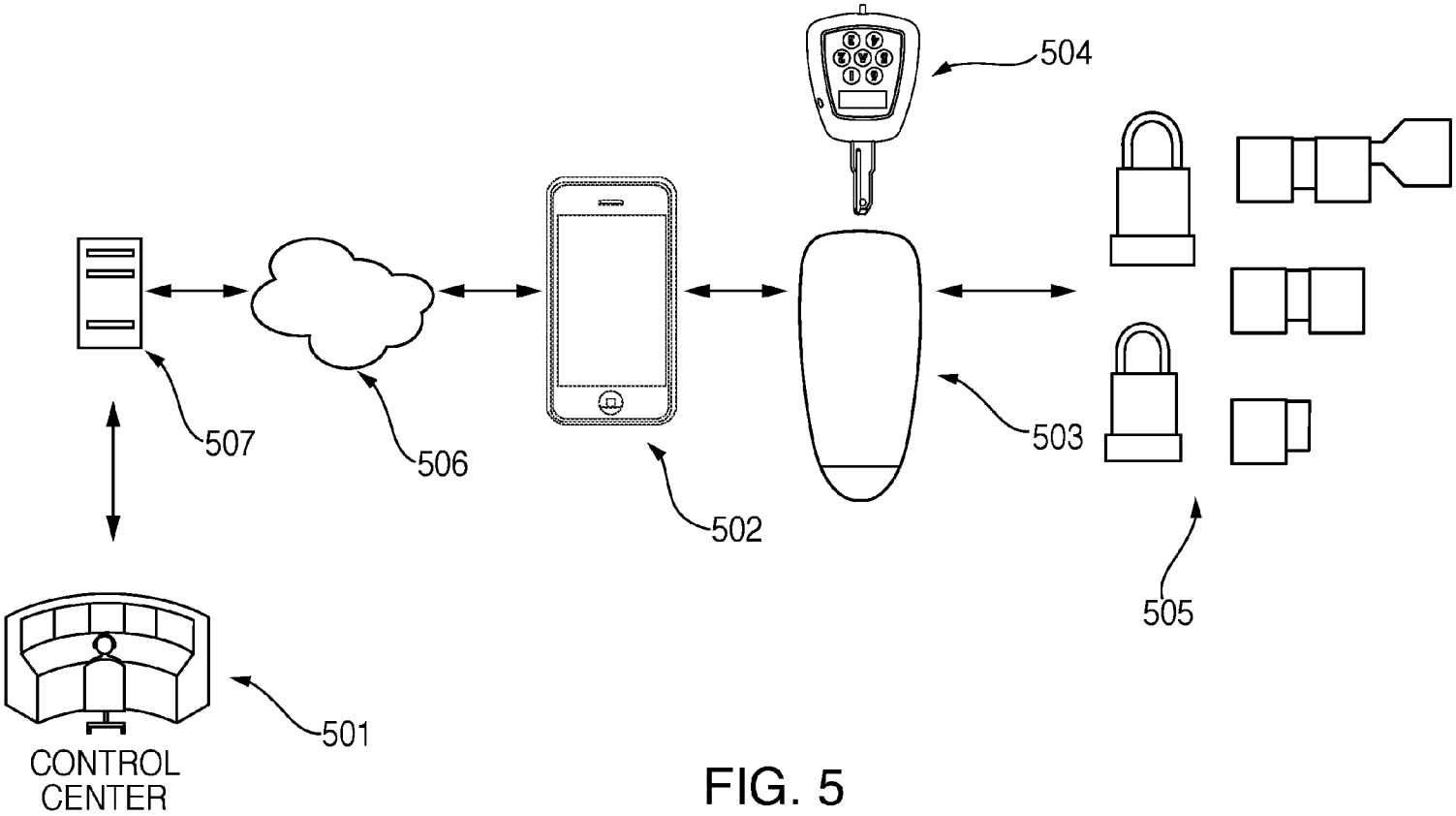
FIG. 5 is a system for obtaining access to and communicating information from a mechatronic lock using a mobile key interface device, electronic programmable key and mobile communication device according to embodiments of the invention.

FIG. 5 depicts a system of communicating access information from an electronic programmable key to a control center using a mobile key interface device, according to embodiments of the invention. The system includes a server (also referred to as a control center) 501, a mobile communication device 502, a mobile key interface device 503, an electronic programmable key 504, a mechatronic lock 505, and a network connection 506. The electronic programmable key 504 communicates to a mobile communication device 502 through the mobile key interface device 503. The mobile communication device may then be used to establish a direct connection to the control center 501, allowing the control center 501 to communicate to the electronic programmable key 504 and mobile key interface device 503. By communicating directly to the control center, the key holder may request passcodes and upload access logs from the electronic programmable keys and mechatronic locks, and the control center may alter access rights for the electronic programmable key in near real-time and on-demand.

The mobile communication device 502 may be a smart phone, tablet, laptop or similar mobile computing device. The mobile communication device may communicate to the control center 501 through a network connection 506, such as GPRS, EDGE, 3G, 4G, or similar phone connection, or wirelessly through Wi-Fi, Bluetooth, RFID, and similar NFC communication protocol. According to certain embodiments, network connection 506 may connect mobile communication device 502 directly to control center 501. In other embodiments, a control center server 507 may receive communication from the mobile communication device 502. Control center server 507 may route communication to the control center 501, where a user may view, respond to, and communicate to the mobile communication device 502, mobile key interface device 503, and electronic programmable key 504. According to certain embodiments, software and/or firmware running on the control center server 507 may automatically respond to, and communicate to the communication device 502, mobile key interface device 503, and electronic programmable key 504 as described in more detail below.

According to one embodiment of the invention, the communication between the control center and the mobile key interface device/electronic programmable key is controlled by application software running on the mobile communication device. The application software may provide a user interface that allows a user to input various requests to the control center. For example, the user interface may allow a user to submit a request for a dynamic passcode to open an authorized mechatronic lock. The user interface may also allow a user to request that his or her access to a mechatronic lock or group of mechatronic locks may be added, edited, or deleted. A user interface may further allow a user to transfer access logs from the electronic programmable key to the control center. In one exemplary embodiment, the mobile communication device may be a smartphone, and the application software may be a mobile app running on a smartphone. The mobile app may communicate requests and receive responses using the smartphone's network connection, which may be a Wi-Fi or cellular connection, for example. In the event the smartphone does not have an internet connection, the smartphone may communicate requests and responses via SMS text, or by initiating a call.

A request for a passcode or a request to alter access rights associated with an electronic programmable key may be accompanied by identification information about the requesting mobile communication device, mobile key interface device, or electronic programmable key. For example, the request for a passcode may include the ID of the electronic programmable key and/or mobile key interface device that is being used to open the mechatronic lock. The control center can then determine whether to grant or deny the passcode request based in part on the ID of the electronic programmable key or mobile key interface device it has received. If, for example, the particular electronic programmable key or mobile key interface device ID has been reported as lost or stolen, then the control center may deny a request for the passcode. Identification information of the mobile communication device may include device identifiers, such as a mobile equipment identifier (MEID) and similar electronic serial numbers, or unique identifiers associated with the application software, such as a universally unique identifier (UUID), globally unique identifier (GUID), or application ID. Similarly, the control center may determine whether to grant or deny the passcode request based in part on the device identifier or software identifier it has received. Thus, if for example the MEID of the mobile communication device or GUID of the application software has been reported as lost or stolen, then the control center may deny the request for a passcode. After determining whether to deny or grant access to the mechatronic lock, the control center may communicate a response directly to the mobile app on the smartphone.

In embodiments where the user has requested a passcode, the control center may either communicate a response containing the passcode to the mobile communication device, or an instruction for the mobile app to generate a passcode. For example, if the control center has approved access to the lock, the control center may generate a passcode using firmware or software on the server and communicate the passcode to the mobile app. Alternatively, instead of communicating the passcode to the mobile communication device, the control center may instruct the mobile app to generate a passcode locally. In embodiments where the passcodes are dynamically generated, the mobile app generates a dynamic passcode based in part on the time of the request. If the passcode is fixed, the mobile app may retrieve the passcode from a list of passcodes stored on the smartphone.

When a passcode has been received from a control center or generated by the mobile app, the mobile app may display the passcode to the user to input onto the keypad of the electronic programmable key. Alternatively, the codes may be communicated directly to the electronic programmable key via the mobile key interface device, using for example, the mobile key interface device's Bluetooth or USB connection. After receiving a valid passcode, the electronic programmable key may then communicate electronically to a mechatronic lock as described above.

According to certain embodiments of the invention, the passcodes that are received or generated by the mobile communication device are not stored in either the mobile communication device or mobile key interface device. The passcodes are generated or retrieved at the control center and may be immediately relayed by the mobile key interface device to the electronic programmable key. In this way, if the mobile communication device or mobile key interface device is lost or stolen, any sensitive passcode information will not be compromised.

The application software on the mobile communication device may be configured to request passcodes or modify access rights automatically or at the remote request of the control center, without the involvement of the user. For example, when the electronic programmable key and mobile key interface device are connected to a mobile communication device, a control center may remotely delete a mechatronic lock ID number from the list of authorized locks stored on the electronic programmable key. As another example, the mobile communication device application software may be configured to automatically request a passcode when the electronic programmable key and mobile key interface device are connected to a mobile communication device.

In certain aspects of the invention, the mobile communication device and mobile key interface device may be used to restrict the use of an electronic programmable key to designated geographic locations. In one embodiment, it may be determined that a user is in a designated geographic location by using the mobile communication device's GPS or geographic positioning capabilities. For example, when a user requests a passcode to a control center to open a mechatronic lock, the application software may concurrently calculate and submit the mobile communication device's location using its GPS or geographic positioning capabilities. The control center may then verify that the user is indeed at the correct geographic location associated with the particular mechatronic lock before providing a response with a passcode. In another embodiment, the mobile communication device may be configured to automatically request a passcode of a mechatronic lock when the user enters a designated geographic location embracing the particular mechatronic lock.

In further aspects of the invention, the mobile communication device and mobile key interface device may be used to track the user's location in real time. The mobile communication device may be configured to continuously calculate and communicate the user's location to the control center. Events such as when a passcode has been requested or when an electronic programmable key has been used to open an mechatronic lock may be combined with the tracking information to create a geographic timeline of when and where a user completed certain actions.

Similarly, the mobile communication device and mobile key interface device may be used to restrict the usage of an electronic programmable key to predetermined times of the day, week, month, or year according to certain aspects of the invention. It may be determined when the user is attempting to use an electronic programmable key with the calendar and clock functionality of the mobile communication device. For example, if an electronic programmable key may only be used on a particular day of the week, then the application software may be configured such that it will not generate a passcode or request a passcode from the control center on any other day of the week. As another example, the mobile communication device may be configured to automatically generate a passcode when it is the designated time for a user to access a particular mechatronic lock. The calendar and clock functionality of the mobile communication device may also be used to automate other periodic tasks such as the transfer of access logs stored on the electronic programmable key. For example, the application software may be configured to upload access logs to the control center on a daily basis at a predetermined time of day.

In one embodiment of the invention, the microcontroller of the electronic programmable key may additionally include a built-in calendar and clock to provide date and time functionality. With the built-in calendar and clock, the electronic programmable key may also be used to limit its use to designated times of the day, week, month, or year. For example, the electronic programmable key may store a table of mechatronic locks and corresponding designated days and/or times that they may be accessed. When an electronic programmable key is inserted into a mechatronic lock, the electronic programmable key may then use its built-in time and calendar to determine if it is authorized to open that particular mechatronic lock at that day and time. If the user is authorized to open the mechatronic lock at that day and time, then the electronic programmable key will send an instruction to a clutch mechanism in the mechatronic lock as described above to allow the mechatronic lock to be opened. If, however, the user is not authorized to open the mechatronic lock at the day or time, then the electronic programmable key will not allow the mechatronic lock to be opened. In other embodiments, the electronic programmable key may only store a list of dates and times when it may be used without reference to a particular mechatronic lock; the electronic programmable key may only be used on these designated dates and times.

In another aspect of the invention, the clock functionalities of the mobile communication device and electronic programmable key may be used to control the duration that a passcode may be valid. For example, the control center may wish to program an electronic programmable key to use mechatronic lock1 at location A for only a limited time of ten minutes, while allowing the electronic programmable key to use mechatronic lock2 for ten hours while at location B. The durations for each of mechatronic lock1 and mechatronic lock2 may be stored as a table in the electronic programmable key, in the mobile communication device, or at the control center. When a user attempts to obtain access to either mechatronic lock1 or mechatronic lock2, the electronic programmable key will store the time that the user entered a passcode. The electronic programmable key may then compare that time with the time it is inserted into the mechatronic lock to determine whether too much time has elapsed since the passcode was entered.

In certain embodiments, the control center may define a set of rules that determine whether to grant or deny a user's request for a passcode or change the access rights of an electronic programmable key. The rules may include lists of electronic programmable keys, mobile key interface devices, mobile communication devices, and mechatronic locks indexed by their identifying information, and corresponding rules which define which devices can access which mechatronic locks, and any applicable restrictions on time and location. For example, the control center may be configured to grant requests for passcodes from an electronic programmable key with ID number 101, a mobile key interface device with ID number 202 and a mobile communication device with ID number 303, on Mondays. Unless a user requests a passcode from electronic programmable key with ID number 101, mobile key interface device with ID number 202 and mobile communication device with ID number 303, and the request is submitted on Monday, the control center will deny the request. Similarly, the control center may be configured to grant a request for a passcode seeking access to mechatronic lock1 if the user is located in a 1 mile radius of the mechatronic lock. If the user is outside the geographic radius, the control center will automatically deny the request for a passcode.

In other embodiments, the control center may be operated by an administrator that determines whether to grant or deny requests for passcodes and access rights on a case-by-case basis. The administrator may be situated at the control center, and grant or deny requests in real time as they are received. In other embodiments, the control center may forward requests to a mobile device operated by the administrator. The administrator may grant or deny access to the requests from using the mobile device.

According to one aspect of the invention, the mobile communication device and mobile key interface device may be used to generate and communicate detailed access logs that record the date and time of different user actions. In one embodiment, the electronic programmable key includes a built-in memory for storing details of when and how it was used. For example, the electronic programmable key may keep logs of the date and time each passcode was entered, whether the passcode was valid or invalid, which mechatronic lock the user attempted to open, and whether the electronic programmable key was authorized to open the mechatronic lock at the particular date and time. In other embodiments, the mobile communication device similarly includes a built-in memory for storing details of when and how the application software was used. For example, the mobile communication device may keep logs of the location, date and time that passcodes were requested, whether and how the passcodes were communicated to the electronic programmable key, the date and time that access rights were changed, and what the specific changes to those access rights were.

In certain embodiments of the invention, the electronic programmable key may also store information about the operability and current status of a mechatronic lock, or electronic programmable key. For example, a mechatronic lock or electronic programmable key may keep records of hardware or software failures, errors, bugs, or failures arising out of unauthorized use. These records may be included with the access logs that are transferred to the control center.

The access logs stored in the mobile communication device or electronic programmable key may be transferred directly to the control center. As described above, the access logs may be transferred directly to the control center by user request, enabling the control center to receive access logs in real-time while the user is in the field, rather than wait for a user to return to a stationary programmer. Alternatively, the access logs may be transferred automatically on a predetermined periodic basis. Access logs stored in the electronic programmable key may be communicated from its local memory to the mobile communication device via the mobile key interface device, which in turn may communicate the access logs to the control center.

One advantage to the presently described invention is that the mobile key interface device may be backward compatible and used with electronic programmable key and lock systems currently deployed and in use. For example, an administrator may remotely create static passcodes for use with all, or a predetermined number of mechatronic locks. The mobile communication device may then communicate the user's location, enabling the key to be used for any time, or during a predetermined window of time.

Variations, modifications, and other implementations of what is described herein may occur to those of ordinary skill in the art without departing from the spirit and scope of the present invention and its claims.

What is claimed is:

1. A system for controlling access to a mechatronic lock, the system comprising:

an electronic programmable key having a microcontroller and a wireless transceiver that transmits and receives information to and from a mobile communication device information through a wireless connection, the mobile communication device being in communication with a control server and being configured to:

communicate information to and from the electronic programmable key through the wireless connection, including retrieving information from the electronic programmable key, alter access rights of the electronic programmable key, and provide on-demand access to the electronic programmable key from the control server in near real-time, wherein upon request from a user to access the mechatronic lock with the electronic programmable key, the mobile communication device is further configured to:

transmit to the control server a unique identification number of the electronic programmable key, the unique identification number enabling the control server to determine whether to grant or deny the dynamic passcode request, receive a dynamic passcode from the control server for unlocking the mechatronic lock, the dynamic passcode being a unique, single-use, time-limited passcode generated based on the time of the request, and transmit the dynamic passcode to the electronic programmable key through the wireless connection for unlocking the mechatronic lock.

2. The system of claim 1, wherein the mobile communication device is configured to request the dynamic passcode from the control server, and wherein the control server determines whether to grant or deny the dynamic passcode request based on the unique identification number of the electronic programmable key and the location of the mobile communication device.

3. The system of claim 1, wherein the mobile communication device is configured to receive modifications to access rights of an electronic programmable key from the control server, wherein the access rights restrict usage of the electronic programmable key based on the location of the mobile communication device.

4. The system of claim 1, wherein the mobile communication device is configured to:

retrieve access logs stored on the electronic programmable key through the wireless connection; and transmit the access logs to the control server.

5. A method for controlling access to a mechatronic lock through an electronic programmable key and a mobile communication device in communication with a control server, the method comprising:

initializing the electronic programmable key;

querying the electronic programmable key for a unique identification information number;

authenticating the electronic programmable key based on the unique identification number;

establishing a wireless connection between the mobile communication device and the electronic programmable key, based on the step of authentication, to facilitate the exchange of communication;

receiving a request to access the mechatronic lock;

submitting a request for a dynamic passcode, the unique identification number enabling the control server to determine whether to grant or deny the dynamic passcode request, the dynamic passcode being a unique, single-use, time-limited passcode generated based on the time of the request; and transmitting the dynamic passcode to the electronic programmable key through the wireless connection for unlocking the mechatronic lock wherein the wireless connection provides on-demand access to the electronic programmable key in near real-time to alter access rights of the electronic programmable key.

6. The method of claim 5 wherein the control server determines whether to provide the dynamic passcode based on the location of the mobile communication device.

7. The method of claim 5 further comprising displaying the dynamic passcode on the mobile communication device.

8. The method of claim 5 further comprising validating the dynamic passcode at the electronic programmable key, the step of validating comprising:

generating a dynamic passcode at the electronic programmable key based on a clock of the electronic programmable key, and determining whether the received dynamic passcode matches the dynamic passcode generated at the electronic programmable key.

9. The method of claim 5, wherein when the electronic programmable key is inserted into the mechatronic lock, the method further comprises:

validating the dynamic passcode at the electronic programmable key;

determining whether to establish communication with the mechatronic lock based on the step of validation;

retrieving identification information of the mechatronic lock;

determining whether the electronic programmable key is authorized to open the mechatronic lock based on the identification information of the mechatronic lock; and instructing the mechatronic lock to engage a clutch mechanism to enable a deadbolt of the mechatronic lock to be rotated based on the step of determining whether the electronic programmable key is authorized to open the mechatronic lock.

10. The method of claim 5 wherein the step of submitting a request for a dynamic passcode further comprises calculating a location of the mobile communication device, and determining whether the mobile communication device is in an authorized geographic area based on the calculated location of the mobile communication device.

11. The method of claim 5 further comprising receiving access rights from the control server at the mobile communication device, wherein the access rights restrict access of the electronic programmable key based on location, time, and identification information of the mechatronic lock.

12. The method of claim 5 further comprising:

communicating access logs from the electronic programmable key to the mobile communication device; and communicating the access logs from the mobile communication device to the control server.

* * * * *